US008240317B2

(12) United States Patent
Aguti et al.

(10) Patent No.: US 8,240,317 B2
(45) Date of Patent: Aug. 14, 2012

(54) DEVICE ADAPTED TO RELEASE A HAIR SUBSTANCE

(75) Inventors: Alberto Aguti, Azzano S. Paolo BG (IT); Arturo Morgandi, Azzano S. Paolo BG (IT); Claudio Mosconi, Azzano S. Paolo BG (IT)

(73) Assignee: Tenacta Group S.p.A., Azzano San Paolo (IT)

( * ) Notice: Subject to any disclaimer, the term of this patent is extended or adjusted under 35 U.S.C. 154(b) by 595 days.

(21) Appl. No.: 12/375,838

(22) PCT Filed: Aug. 1, 2006

(86) PCT No.: PCT/IT2006/000594

§ 371 (c)(1),
(2), (4) Date: Jan. 30, 2009

(87) PCT Pub. No.: WO2008/015704

PCT Pub. Date: Feb. 7, 2008

(65) Prior Publication Data

US 2009/0308407 A1 Dec. 17, 2009

(51) Int. Cl.
*A45D 20/08* (2006.01)

(52) U.S. Cl. ..... 132/271

(58) Field of Classification Search ..... 132/271, 132/272

See application file for complete search history.

(56) References Cited

U.S. PATENT DOCUMENTS

| | | | | |
|---|---|---|---|---|
| 4,597,191 | A | 7/1986 | Juzefczyk | |
| 4,875,792 | A | 10/1989 | Canada | |
| 5,241,974 | A * | 9/1993 | Tsai | 132/272 |
| 5,572,800 | A | 11/1996 | West | |
| 5,649,370 | A | 7/1997 | Russo | |
| 5,761,824 | A | 6/1998 | Moon et al. | |
| 5,857,470 | A | 1/1999 | Schmidt et al. | |
| 5,913,315 | A | 6/1999 | Todd | |
| 5,987,771 | A | 11/1999 | Curtin | |
| 6,053,178 | A | 4/2000 | Todd | |
| D459,025 | S | 6/2002 | Seiffert | |
| 2001/0010990 | A1 * | 8/2001 | Erdos et al. | 442/394 |
| 2003/0159306 | A1 | 8/2003 | Yeung | |

FOREIGN PATENT DOCUMENTS

| | | | |
|---|---|---|---|
| EP | 0523743 | B1 | 1/1993 |
| EP | 1360954 | | 11/2003 |
| JP | 2000135111 | A | 5/2000 |
| JP | 2003094569 | A | 4/2003 |
| WO | 0226279 | A | 4/2002 |
| WO | 2005087039 | | 9/2005 |

* cited by examiner

*Primary Examiner* — Rachel Steitz
(74) *Attorney, Agent, or Firm* — Husch Blackwell LLP

(57) ABSTRACT

A hair conditioner module adapted to release, in working conditions, a hair substance, comprising a support material soaked with a hair substance and being selected from the group comprising a polyolefin bicomponent fiber and polytetrafluoroethylene.

38 Claims, 2 Drawing Sheets

DEVICE ADAPTED TO RELEASE A HAIR SUBSTANCE

CROSS-REFERENCE TO RELATED APPLICATIONS

This application claims priority to international application PCT/IT2006/000594 filed on Aug. 1, 2006.

BACKGROUND OF THE INVENTION

1. Field of the Invention

The present invention refers to a device adapted to release, in working conditions, a hair cosmetic substance. The present invention also refers to an electrical apparatus for hair treating adapted to contain such a device and to an accessory, adapted to contain the device itself, adapted to be applied to an electrical apparatus for hair treating.

Examples of such apparatuses are hairdryers, straighteners, hairstylers or curlers, intensively used for hair treating, both in professional hair salons and within homes. Examples of hair treatments are drying and any styling operation, such as for example, setting, straightening or curling of hair.

In particular, the device of the invention may be used in a hairdryer or in an accessory adapted to be applied to a hairdryer.

2. Related Art

Various attempts have been made to incorporate supports in hairdryers that release hair treatment agents, under the action of hot air flow.

For example, U.S. Pat. No. 4,597,191 describes a method for transferring a treatment agent onto hair through the passage of hot air through a support material containing such a treatment agent. The supports described in such a patent are made from paper or non-woven fabric, such as, for example, non-woven rayon. Similarly, U.S. Pat. No. 5,761,824 describes an accessory arranged in the outlet nozzle of a hairdryer comprising a fibrous sponge-like support material like cloth or cotton containing a hair treatment agent. International Patent Application WO No. 2005/087039 describes an accessory for hair treatment that rotates when exposed to the hot air flow of the hairdryer to which it is applied. Such an accessory is made from absorbent or semi-absorbent support material such as polyester, cotton, wood or other and contains a hair treatment agent.

However, the materials of the supports described in such patents have the disadvantage of not being able to absorb relevant amounts of substance and of breaking up over time, thus being unable to keep the substance inside them before the substance is transferred onto the hair. For example, paper is not stable over time in shape and structure and, if wetted, loses consistency. The weakening of the seal over time of such materials scan cause dripping of the hair substance contained inside them, the substance generally being in liquid state, causing waste of material, problems linked to electrical safety when such support materials are inserted into electrical apparatuses and problems linked to the cleaning of these apparatuses. Such materials described in the art are also difficult to model in solid form, unless glues are used that could reduce their absorption and that could be toxic, and therefore difficult to adapt or insert into housings present in electrical apparatuses for hair treatment. Finally, the organic materials of the supports described in the art, for example paper, cellulose, wood, wood pulp and cotton, are unable to release substantially all of the hair substance held here; indeed, heavy organic molecules, for example proteins, generally present in such a hair substance, amalgamate with such organic materials of the supports, making it difficult for the hair substance to be released in a limited period of time during a working step.

Other patents describe accessories for fragrances containing hairdryers.

For example, U.S. Pat. No. 5,572,800 describes a porous material adapted to release a fragrance contained in an accessory applied to a hairdryer. U.S. Pat. No. 5,649,370 describes a hairdryer containing a diffusion system of a fragrance by means of a box containing a cream or gel. U.S. Pat. No. 5,987,771 describes a removable perfumed capsule placed in the nozzle of a hairdryer and arranged perpendicular to the air flow. US Patent Application No. 2003/0159306 discloses a bar made from a sponge-like or ceramic material adapted to absorb or to be filled with fragrances, such as a bar being placed in a diffuser arranged perpendicular to the air flow. Ceramic (alumina, $Al_2O_3$) has the disadvantage of being a very hard material, difficult to agglomerate, and powdery, with consequent problems of irritation of the skin, the eyes and the airways.

Such patents describe the diffusion of fragrances to perfume hair; in this context, it is sufficient to distribute a few milligrams of such a fragrance to obtain an acceptable perfuming of the hair and therefore it is not necessary to subject the material that contains such a fragrance to particularly high temperatures for long periods of time. Therefore, in such patents the problem regarding the need for resistance of the support material to high temperatures and the need to absorb and release a substantial amount of hair substance in a limited period of time is not analysed in detail.

The prior art does not provide a device that: 1) has a high absorption factor of hair substance; 2) when it is in rest conditions, it is adapted to hold over time the absorbed substance at its inside so as to avoid losses and waste of such a substance; 3) when it is in working conditions, it is adapted to release, through vaporisation, substantially all of the substance held therein in a limited period of time; and 4) is adapted to withstand high temperatures (for example, above 70° C.) without emitting harmful or toxic substances and without deteriorating.

SUMMARY OF THE INVENTION

In the scope of the present description and in the subsequent claims, the term "in rest conditions" means a situation wherein the device is generally kept at room temperature and is not subjected to a current hot air flow. The typical situation of rest condition is where the device is stored in a package sealed in atmosphere or modified atmosphere or in a vacuum and left therein until the time of use to release the substance held therein. The term "in working conditions", as used herein means a situation wherein the device is under a current hot air flow and/or is heated to a temperature of at least 40° C. The typical situation of working condition is where the device is inserted into an electrical apparatus for hair treatment or in an accessory to be applied to such apparatuses and therein subjected to hot air flow and/or to heating.

In accordance with a first aspect of the invention, a device comprises a support material selected from the group comprising i) a polyolefin bicomponent fibre and ii) polytetrafluoroethylene (PTFE) is able to have a high absorption factor of hair substance, for example of at least 1 gram, and to hold a hair substance at its inside, in rest conditions, for long periods of time, for example at least one year, without deteriorating. Indeed, the device of the present invention is soaked with such a hair substance, generally in aqueous and/or oily form, which is absorbed and held over time, in rest conditions, by the device itself.

In this way, the substance is advantageously prevented from leaking from the device of the present invention, thus avoiding it being wasted contrary to what occurs using prior art means made with materials that break up with the passing of time, causing the substance held inside them to drip.

Advantageously, the device of the present invention also releases, through vaporisation, in working conditions, substantially all of the hair substance that was held within it in rest conditions, in average hair drying/styling times. Indeed, in this way, there is the advantage of avoiding that part of such a substance remain incorporated and held in the device itself, contrary to certain devices of the prior art made from organic material (like paper, cellulose and wood), to which the heavy organic molecules generally present in the hair substance remain linked.

Advantageously, the device of the present invention is also such as to make hair treatment effective, allowing the substance contained in such a device to be released in vaporised form, thus allowing the droplet of such a substance to continuously and uniformly reach the hair for the entire duration of the treatment. Such an application is more uniform with respect to manual application of the hair substance.

Moreover, the device of the present invention is made from a material that has a melting point that varies within the range from about 95° C. to about 160° C. and has an autogenous ignition temperature that varies within the range from about 350° C. to about 400° C. The device of the present invention is therefore such as to withstand heat when inserted into electrical apparatuses (for example a hairdryer) and subjected to working steps for hair treatment, at the same time without emitting harmful or toxic substances.

The device of the present invention may comprise a support material in polyolefin bicomponent fibre; more preferably in polyethylene and polypropylene bicomponent fibre, where for polyethylene is intended low density polyethylene (LDPE), medium density polyethylene (MDPE), high density polyethylene (HDPE), linear low density polyethylene (LLDPE), ultra low density polyethylene (ULDPE), or mixtures thereof.

In this way, the device of the present invention has the advantage of being made from a material such as to be able to be easily shaped in the desired solid form, which is kept unchanged both when the device is in rest conditions, and during and at the end of the working conditions of hair treatment.

The device of the present invention may comprise a support material in polyethylene and polypropylene fibre, wherein the amounts of polyethylene and polypropylene are, respectively, within the range 20%-80% and 80-20%, in molar percentage with respect to the total number of mols of the bicomponent fibre. More preferably, the amounts of polyethylene and polypropylene are, respectively, within the range 30%-70% and 70%-30% in molar percentage with respect to the total number of mols of the bicomponent fibre.

In this way, the device of the present invention has the advantage of being made from a material in bicomponent fibres wherein the fibres are compacted so as to obtain suitable densities according to the desired degree of absorption of the hair substance.

The hair substance may comprise cosmetic elements, such as, for example, proteins, silk proteins, vitamin C, vitamin E, panthenol (vitamin B5), vitamin B6, vitamin PP, amino acids, keratin, vegetable extracts, silicone oils, such as, for example, cyclomethicone, dimethylconol, dimethicone, phenyl trimethicone, essential oils, and similar. Such cosmetic elements are preferably mixed with aqueous, oily or mixed with aqueous, oily or mixed oily/aqueous solvent.

In this way, it is possible to have a greater amount of substance to be able to convey towards the hair during the working step, with respect to the situation wherein such cosmetic elements are not mixed in such solvents.

The hair substance may have characteristics of good volatility to be able to be more easily transferred from the device of the present invention to the hair during the working steps. Such transferral occurs by evaporation of the hair substance under the effect of heat and/or a hot air flow.

In a first embodiment, the hair substance, held by the device of the present invention in rest conditions, is water-based and the device of the present invention comprises a support material in a polypropylene and polyethylene bicomponent fibre.

In this way an absorption ratio of the water-based substance by the device of the present invention within the range from 1:2.5 to 1:6, calculated as dry weight with respect to the total wet weight, is advantageously obtained, where with a ratio of 1:6 the material with a dry weight of 1 gram becomes 6 grams of total wet weight when it is soaked.

In this way, according to the first embodiment cited above, the hair substance, when released in working conditions, allows a better hair hydration, as 30 well as a better hair softness and hair comb manageability.

In a second embodiment, the hair substance, held by the device of the present invention in rest conditions, is oil-based and the device of the present invention comprises a support material in a polypropylene and polyethylene bicomponent fibre or a support material in PTFE.

In this way an absorption ratio of the substance by the device of the present invention within the range from 1:2 to 1:5.5, dry weight with respect to total wet weight, for polypropylene and polyethylene bicomponent fibre and within the range from 1:1.1 to 1:1.4, dry weight with respect to total wet weight, for a support material in PTFE, is advantageously obtained.

In this way, according to the second embodiment cited above, the hair substance, when released in working conditions, allows a better hair softness, an improvement of the protective sheath, a reinforcement of 15 the tips and a tidier hair set.

The support material of the device of the present invention may comprise some cavities on its outer surface; such cavities allows the support material to better hold the hair substance, in rest conditions. More preferably, the support material also comprises some cavities at its inside, connected to said cavities on the outer surface; in this way the support material is such that the device of the present invention, in rest conditions, is more soaked with the hair substance, for example up to 15 ml.

The device of the present invention is produced through conventional manufacturing processes, such as, for example, an extrusion process adapted to create a cauterisation of the outer parts to prevent weakening and, therefore, breaking up of the outer surfaces over time.

Such a device may be solid and parallelepiped-shaped having square or rectangular section; such a shape allows the device itself to be easily inserted, before the start of the working steps of hair treatment, in suitable housings present in the electrical apparatuses for hair treatment or in accessories to be applied to such apparatuses. Moreover, the device can also be equally easily removed at the end of such working steps.

Advantageously, the device of the present invention is placed in special packs adapted to storage and stability of the hair substance contained therein over time, such as, for example, packs sealed in air or in modified air or in a vacuum.

The device is then removed from the pack only at the moment of use and directly inserted into special housings present in the electrical apparatus. Therefore no further action by the user is necessary, such as, for example, mixing of components and relative dosing to obtain the hair substance in the suitable composition to start hair treatment.

The device of the present invention may be present in single-use or disposable packs, in the sense that each device contains the right amount of substance for a single hair treatment.

In this way, the device of the present invention in single-use packs avoids the user the problem of having to repeatedly check, during the working step, the amount of hair substance used up to that moment, since all of such an amount is to be used during the average period of time requested for an entire hair treatment.

At the end of each individual hair treatment, for example at the end of drying, the device, substantially free of the substance that has been released, is removed from the special housing present in the electrical apparatus so as to leave free the housing itself where a new device can be inserted before the beginning of a new hair treatment.

In accordance with a second aspect, the present invention relates to a hair electrical apparatus as defined in attached claim 12.

According to the invention, it has indeed been found that an electrical apparatus for hair treating allows to avoid possible losses of liquid hair substance that, coming into contact with electrical cables, can generate electrical safety problems, such as, for example, short circuits, when the electrical apparatus itself is in the working step, and at the same time allows to avoid cleaning problems of the apparatus itself.

The electrical apparatus of the present invention may comprise the previously described device.

The electrical apparatus may comprise at least one housing for the insertion of such a device therein.

Advantageously, said housing is provided with parallel guides to make it easier to insert such a device. Preferably, said housing is also provided with means for locking the device inside the housing.

Advantageously, the shape of the device is such as to occupy the space between said guides and said locking means. In this way, the device, once inserted in the housing, is locked between said guides and said locking means so as to be in a still and stable position during the working steps.

The electrical apparatus may be a hairdryer. In another embodiment, the hairdryer comprises a housing arranged so that the device inserted therein is arranged along the hot air flow that flows from inside the hairdryer towards the outside during the working steps. In such a position, there is the advantage of promoting the air flow, minimizing the opposition by the device, at the expense of the release of the hair substance; however, the good quality of the support material of the device that releases such a substance makes up for the unfavourable position of the device, in any case ensuring a good distribution of the substance on the hair.

In another embodiment, the housing is arranged in such a way that the device inserted therein is transversally arranged to such a hot air flow. Such a position promotes the release of the hair substance, at the expense of the good flowing of the air flow.

The hairdryer may be provided with a device for the automatic or manual regulation of the parameters related to the air flow, such as, for example, temperature, flow speed, power. It is therefore possible to set such parameters so as to obtain the best values according to the hair treatment required on each occasion.

In accordance with a third aspect, the present invention relates to an accessory as defined in attached claim 18.

The accessory of the present invention is adapted to contain at its inside such a device adapted to release a hair substance, in working conditions.

Advantageously, the accessory of the present invention, for example a nozzle, is adapted to be applied to an electrical apparatus for hair treating, such as, for example, a hairdryer.

Advantageously, the accessory of the present invention, with the proper adjustments, is also adapted to be applied to other electrical apparatuses for hair treatment, such as, for example, straighteners, curlers, and similar.

In this way, the same advantages previously described with reference to an electrical apparatus adapted to directly contain the device itself can be obtained, with the further practical advantage of being able to apply such an accessory to the electrical apparatus only at the moment when needed.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
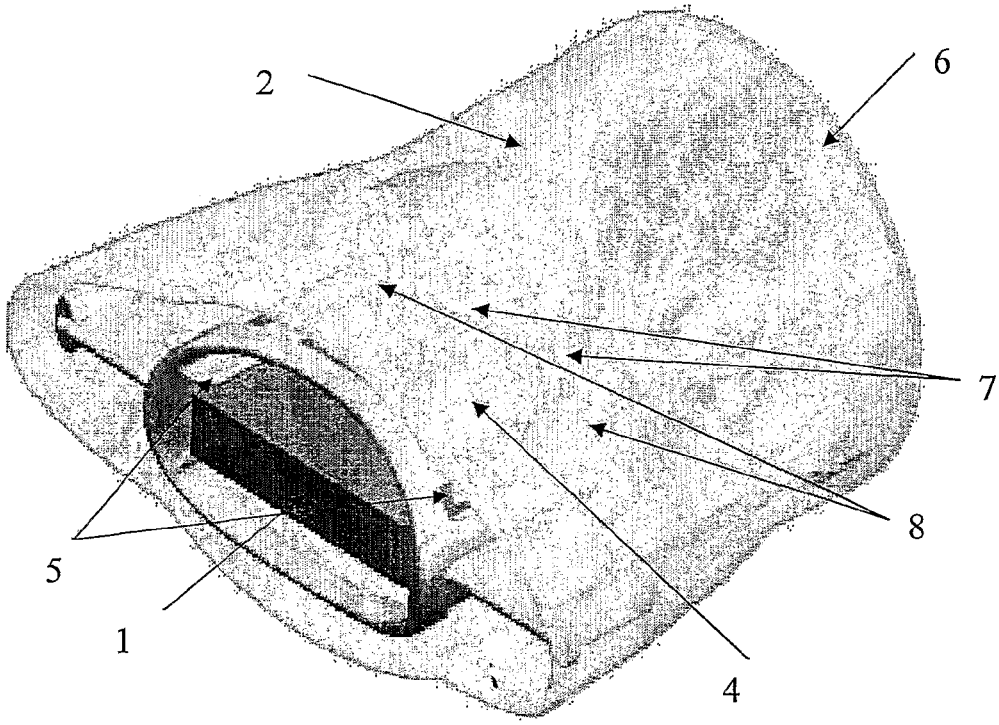
FIG. 1 is a perspective view of a preferred embodiment of an accessory containing a device in accordance with the present invention.
Figure 2:
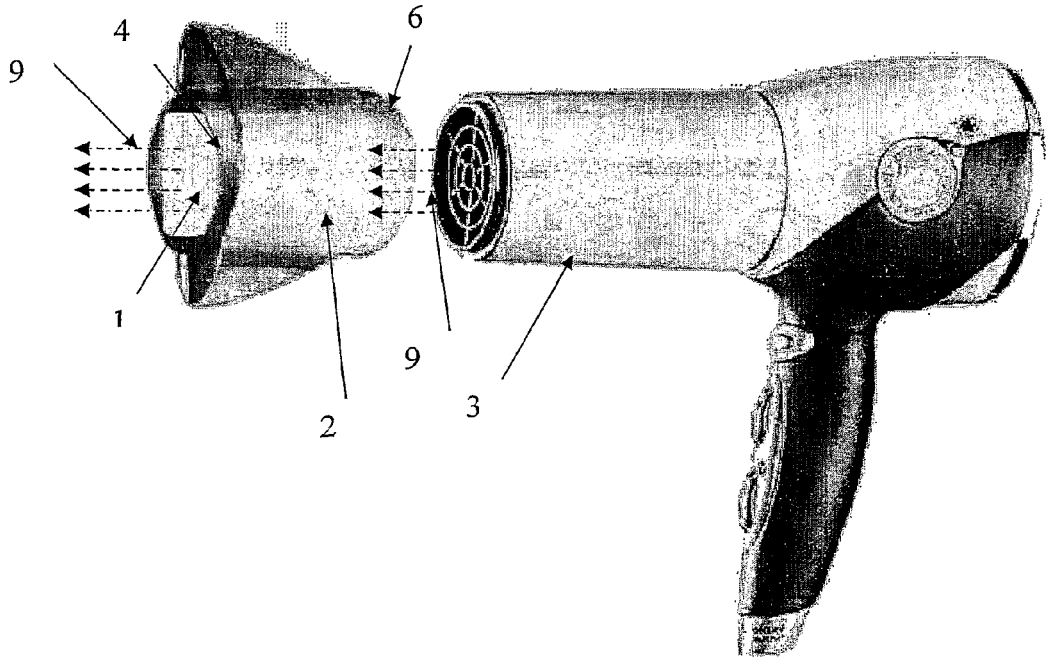
FIG. 2 is a perspective view of the accessory shown in FIG. 1 adapted to be applied to a hairdryer.

With reference to FIGS. 1 and 2, a device according to the invention made with a support material in polyethylene and polypropylene bicomponent fibre (molar percentage 50/50) is indicated with 1. The device 1, in rest conditions, is soaked with a water and/or oil-based hair substance and is able to absorb up to 15 ml of such a substance by means of some cavities present on its outer and internal surfaces. Such a substance remains soaked in the device 1 for all the time wherein the device 1 stays in rest conditions, without any leakage of the substance occurring.

With reference to FIG. 1, such a device 1 is parallelepiped-shaped with square section and is inserted in a housing 4 present in the accessory 2. The housing 4 is provided with lateral guides 5, arranged parallel to each other to make it easier to insert the device 1. The shape of the device 1 is such as to allow the device 1 itself to slide in contact with such lateral guides 5 and to occupy the space between the lateral guides 5, the rear guides 7 and the locking clamps 8. In this way, the device 1, once inserted into the housing 4, is locked between the lateral guides 5, the rear guides 7 and the clamps 8 in still and 5 stable position during the working steps.

The accessory 2 (see FIG. 2) is then applied to a hairdryer 3 through the rounded opening 6. The housing 4 present in the accessory 2 is positioned so that, once the device 1 has been inserted therein, such a device 1 is positioned along the hot air flow 9 that, during the working steps, flows inside the hairdryer 3 towards the outside. This fact makes it easier to release the hair substance that, in working step, by the effect of heat, vaporises and, following the hot air flow 9, comes out from the device 1 and reaches the hair. In this way there is uniform distribution of the hair substance onto the hair.

Of course, the embodiments described above must be taken as mere non-limiting illustrations of some possible embodiments of the device of the present invention, clearly 20 remaining understood that any element inherent to the device itself can be varied by the man skilled in the art to satisfy specific and contingent requirements, whilst still remaining within the scope of what is claimed.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

The invention claimed is:

1. A hair conditioner apparatus adapted to release, in working conditions, a hair substance for conditioning hair, said apparatus comprising:

a support material, said support material being selected from the group comprising i) a polyolefin bicomponent fibre and ii) polytetrafluoroethylene;

said support material absorbing the hair substance such that said support material and the hair substance remain stable when in a rest condition and such that the hair substance is released when in a working condition, said working condition being at least one of heat and a hot air flow.

2. The hair conditioner apparatus of claim 1 further comprising said bicomponent fibre comprising a polypropylene and polyethylene bicomponent fibre.

3. The hair conditioner apparatus of claim 2 further comprising the amount of polyethylene in molar percentage with respect to the total number of mols of the bicomponent fibre being within the range from about 20% to about 80%.

4. The hair conditioner apparatus of claim 2 further comprising the amount of polyethylene in molar percentage with respect to the total number of mols of the bicomponent fibre being within the range from about 30% to about 70%.

5. The hair conditioner apparatus of claim 2 further comprising the amount of polypropylene in molar percentage with respect to the total number of mols of the bicomponent fibre being within the range from about 20% to about 80%.

6. The hair conditioner apparatus of claim 2 further comprising the amount of polypropylene in molar percentage with respect to the total number of mols of the bicomponent fibre being within the range from about 30% to about 70%.

7. The hair conditioner apparatus of claim 1 further comprising the hair substance being water, oil or mixed water/oil-based.

8. The hair conditioner apparatus of claim 7 further comprising the support material being a polypropylene and polyethylene bicomponent fibre and the hair substance being water and/or oil-based.

9. The hair conditioner apparatus of claim 7 further comprising the support material being polytetrafluoroethylene and the hair substance being oil-based.

10. The hair conditioner apparatus of claim 1 further comprising said support material comprising cavities on its outer and inner surface adapted to hold the hair substance, in rest conditions.

11. The hair conditioner apparatus of claim 1 further comprising said support material being packed in single-use packs.

12. The hair conditioner apparatus of claim 1 further comprising said hair conditioner apparatus being mounted on an electrical hair treatment apparatus.

13. The hair conditioner apparatus of claim 12 wherein said electrical hair treatment apparatus is a hairdryer.

14. The hair conditioner apparatus of claim 12 further comprising the electrical hair treatment apparatus comprising at least one housing and the hair conditioner apparatus being mounted inside said housing.

15. The hair conditioner apparatus of claim 12 wherein the electrical hair treatment apparatus is one of a straightener or a hair styler or a curler.

16. The hair conditioner apparatus of claim 14, further comprising the at least one housing having guides disposed to receive said hair conditioning apparatus.

17. The hair conditioner apparatus of claim 14 wherein said electrical hair treatment apparatus is a hairdryer and said hair conditioner apparatus is mounted in said housing longitudinally with respect to a hot air flow that flows from inside the hairdryer towards the outside during the working steps.

18. The hair conditioner apparatus of claim 14 wherein said electrical hair treatment apparatus is a hairdryer and said hair conditioner apparatus is mounted in said housing transversally to a hot air flow that flows from inside the hairdryer towards the outside during the working steps.

19. The hair conditioner apparatus of claim 1 further comprising said hair conditioner apparatus being mounted on an accessory attachable to an electrical hair treatment apparatus.

20. The hair conditioner apparatus of claim 19 wherein said electrical hair treatment apparatus is a hairdryer.

21. The hair conditioner apparatus of claim 19 wherein said accessory is a nozzle for a hairdryer.

22. The hair conditioner apparatus of claim 19 further comprising the electrical hair treatment apparatus comprising at least one housing and the hair conditioner apparatus being mounted inside said housing.

23. The hair conditioner apparatus of claim 22, wherein said housing having guides disposed to receive said hair conditioner apparatus.

24. The hair conditioner apparatus of claim 22 further comprising said electrical hair treatment apparatus being a hairdryer and said hair conditioner apparatus being mounted in said housing longitudinally with respect to a hot air flow that flows from inside the hairdryer towards the outside during the working steps.

25. The hair conditioner apparatus of claim 22 further comprising said electrical hair treatment apparatus being a hairdryer and said hair conditioner apparatus being mounted in said housing transversally to a hot air flow that flows from inside the hairdryer towards the outside, during the working steps.

26. The hair conditioner apparatus of claim 1 wherein said heat of said working condition is at least about 40° C.

27. The hair conditioner apparatus of claim 1 wherein said support material is retained in one of a nozzle, a straightener, a curler and a package for mounting in one of said nozzle, said straightener, or said curler.

28. The hair conditioner apparatus of claim 1 wherein said hair conditioning substance vaporizes in said working condition.

29. The hair conditioner apparatus of claim 1 wherein said support material absorbs said hair substance for at least about 1 gram.

30. The hair conditioner apparatus of claim 1 wherein said support material remains stable during storage of said hair conditioner apparatus at room temperature.

31. The hair conditioner apparatus of claim 1 wherein said support material contains cavities.

32. The hair conditioner apparatus of claim 31 wherein said cavities are inside said support material.

33. The hair conditioner apparatus of claim 31 wherein said cavities are outside said support material.

34. The hair conditioner apparatus of claim 1 wherein said hair substance has an absorption ratio of hair substance to support material of in a range from about 1:2 to about 1:6 calculated as dry weight with respect to total weight, said absorption ratio corresponding to 1 unit of dry support material to about 2 to about 6 units of support material with absorbed hair conditioning substance.

35. The hair conditioning apparatus of claim 1 wherein said hair substance includes at least one of, proteins, silk proteins, vitamin C, vitamin E, panthenol, vitamin B-5, vitamin B-6, vitamin PP, amino acids, keratin, vegetable extracts, silicon oils, cyclomethicone, dimethylconol, dimethicone, phenyl, trimethicone and essential oils.

36. The hair conditioning apparatus of claim 1 wherein said support material has a melting point greater than about 95° C. and an ignition point greater than about 350° C.

37. An Electrical apparatus for hair treating comprising a hair conditioning apparatus which is adapted to release, in working conditions, a hair substance for conditioning hair, said hair conditioning apparatus comprising:

a support material, said support material being selected from the group comprising i) a polyolefin bicomponent fibre and ii) polytetrafluoroethylene;

said support material absorbing the hair substance such that said support material and the hair substance remain stable when in a rest condition and such that the hair substance is released when in a working condition, said working condition being at least one of heat and a hot air flow;

the electrical apparatus being a hairdryer, a straightener, a hairstyler or a curler.

38. An Electrical apparatus for hair treating comprising a hair conditioning apparatus which is adapted to release, in working conditions, a hair substance for conditioning hair, said hair conditioning apparatus comprising:

a support material, said support material being selected from the group comprising i) a polyolefin bicomponent fibre and ii) polytetrafluoroethylene;

said support material absorbing the hair substance such that said support material and the hair substance remain stable when in a rest condition and such that the hair substance is released when in a working condition, said working condition being at least one of heat and a hot air flow; and wherein said support material is within a package, said package having parallel guides and a locking clamp, each of said parallel guides and said locking clamp corresponding to a receiving structure on a hair conditioner apparatus.

* * * * *